US009459578B2

(12) United States Patent
Hara et al.

(10) Patent No.: US 9,459,578 B2
(45) Date of Patent: Oct. 4, 2016

(54) IMAGE FORMING APPARATUS

(71) Applicant: FUJI XEROX CO., LTD., Tokyo (JP)

(72) Inventors: Toko Hara, Kanagawa (JP); Yoshiyuki Tominaga, Kanagawa (JP); Kenji Sawai, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/851,613

(22) Filed: Sep. 11, 2015

(65) Prior Publication Data

US 2016/0246215 A1 Aug. 25, 2016

(30) Foreign Application Priority Data

Feb. 20, 2015 (JP) ..... 2015-031996

(51) Int. Cl.
*G03G 15/36* (2006.01)
*G03G 15/16* (2006.01)
*G03G 15/00* (2006.01)

(52) U.S. Cl.
CPC ..... *G03G 15/5025* (2013.01); *G03G 15/16* (2013.01)

(58) Field of Classification Search
CPC ..... G03G 15/5025; G03G 15/5029; G03G 15/16
USPC ..... 399/45
See application file for complete search history.

(56) References Cited

U.S. PATENT DOCUMENTS 5,493,386 A * 2/1996 Thompson ..... G03G 15/01 382/181
6,434,346 B1 * 8/2002 Knott ..... G03G 15/0855 399/27
2003/0059697 A1 * 3/2003 Dontula ..... B32B 27/08 430/104
2004/0252342 A1 * 12/2004 Kawahira ..... G03G 15/047 358/1.18

FOREIGN PATENT DOCUMENTS

JP 2006-317632 A 11/2006

* cited by examiner

*Primary Examiner* — Walter L Lindsay, Jr.
*Assistant Examiner* — Philip Marcus T Fadul
(74) *Attorney, Agent, or Firm* — Sughrue Mion, PLLC

(57) ABSTRACT

An image forming apparatus includes a forming unit that forms a toner image with a substantially flat toner containing a substantially flat metal pigment on a movable body; a transfer unit that forms a nip with the movable body and transfers the toner image on a medium transported to the nip; and a controller that, if at least one of first and second conditions, the first condition in which an image width from data for allowing the forming unit to form the toner image is larger than a predetermined width, the second condition in which an area coverage from the data is higher than a predetermined area coverage, is satisfied, causes the forming unit to form a toner image with a corrected area coverage lower than the area coverage from the data.

6 Claims, 14 Drawing Sheets

IMAGE FORMING APPARATUS

CROSS-REFERENCE TO RELATED APPLICATIONS

This application is based on and claims priority under 35 USC 119 from Japanese Patent Application No. 2015-031996 filed Feb. 20, 2015.

BACKGROUND

The present invention relates to an image forming apparatus.

SUMMARY

According to an aspect of the invention, there is provided an image forming apparatus including a forming unit that forms a toner image with a substantially flat toner containing a substantially flat metal pigment on a movable body; a transfer unit that forms a nip with the movable body and transfers the toner image on a medium transported to the nip; and a controller that, if at least one of first and second conditions, the first condition in which an image width from data for allowing the forming unit to form the toner image is larger than a predetermined width, the second condition in which an area coverage from the data is higher than a predetermined area coverage, is satisfied, causes the forming unit to form a toner image with a corrected area coverage lower than the area coverage from the data.

BRIEF DESCRIPTION OF THE DRAWINGS

Exemplary embodiments of the present invention will be described in detail based on the following figures, wherein.

DETAILED DESCRIPTION

Overview

Figure 1:
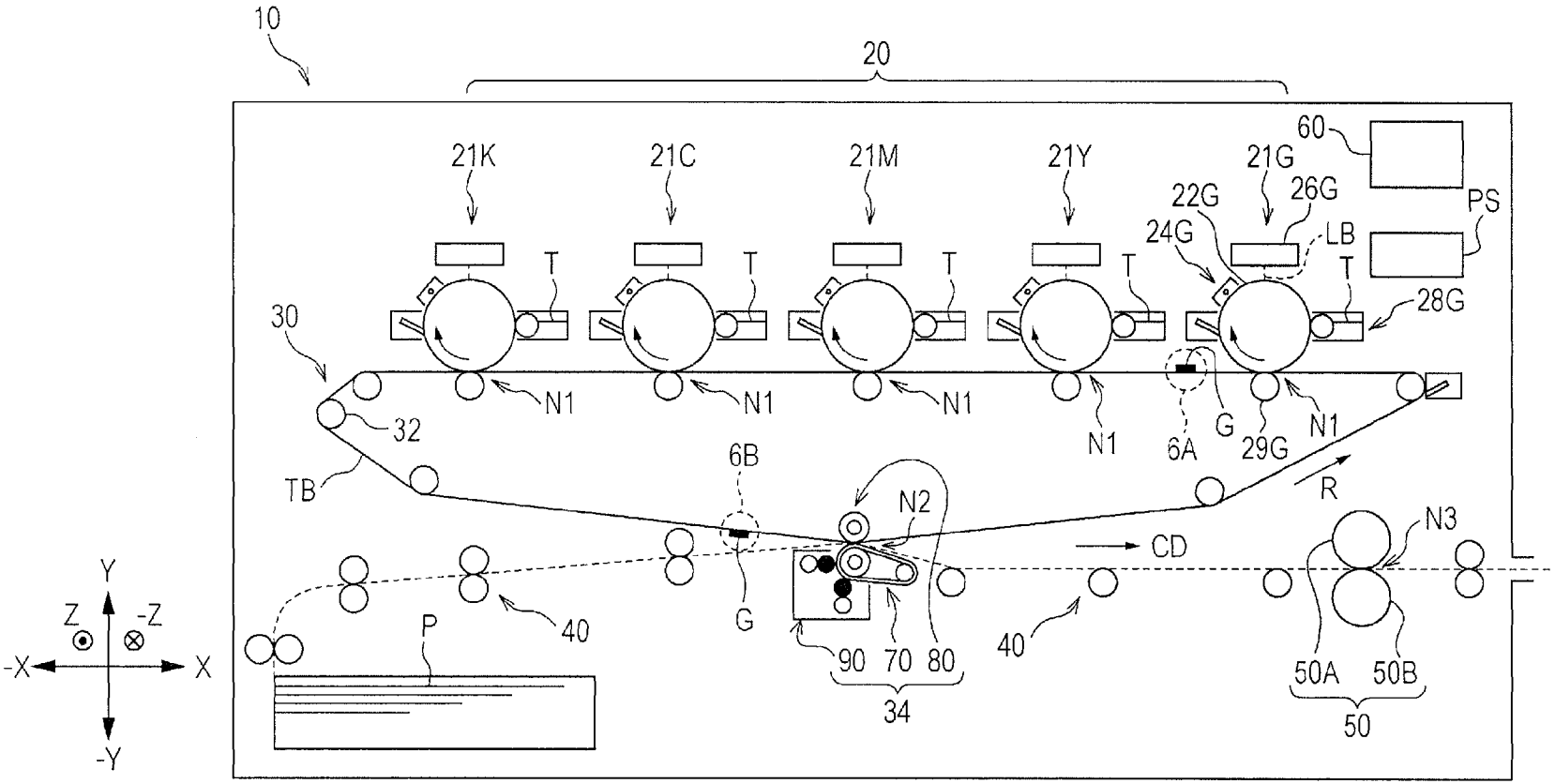
FIG. 1 is schematic view (front view) of an image forming apparatus according to a first exemplary embodiment.

An exemplary embodiment for implementing the invention (hereinafter, referred to as exemplary embodiment) is described below. First, a configuration of an image forming apparatus 10 (see FIG. 1) of this exemplary embodiment and a toner (see FIGS. 4 and 5) that is used by the image forming apparatus 10 are described. Then, an image forming operation of the image forming apparatus 10 of this exemplary embodiment is described. Then, effects of this exemplary embodiment are described.

In the following description, directions indicated by arrow X and arrow −X in the drawings represent an apparatus width direction, and directions indicated by arrow Y and arrow −Y in the drawings represent an apparatus height direction. Also, directions (arrow Z and arrow −Z directions) orthogonal to the apparatus width direction and the apparatus height direction represent an apparatus depth direction.

Configuration of Image Forming Apparatus

As shown in FIG. 1, the image forming apparatus 10 is an apparatus using an electrophotographic system including a toner image forming unit 20, a transfer device 30, a transport device 40, a fixing device 50, a controller 60, and a power supply PS.

Toner Image Forming Unit

The toner image forming unit 20 has a function of forming a toner image G (see FIGS. 1 and 6) on a transfer belt TB (described later), which configures the transfer device 30, by executing respective processes of electric charge, exposure, and development.

The toner image forming unit 20 includes single-color units 21G, 21Y, 21M, 21C, and 21K that form toner images G of different colors (G (gold), Y (yellow), M (magenta), C (cyan), K (black)). The single-color units 21G, 21Y, 21M, 21C, and 21K have similar configurations except the colors of the respectively formed toner images G. Hereinafter, in the specification and drawings, the alphabets (G, Y, M, C, K) of the single-color units 21G, 21Y, 21M, 21C, and 21K are omitted unless otherwise the single-color units 21G, 21Y, 21M, 21C, and 21K and their components are required to be distinguished from one another.

The single-color unit 21G forms a toner image G with a flat or substantially flat toner MT (hereinafter, referred to as toner MT, see FIG. 4), which is described later, on the transfer belt TB. The single-color unit 21G is an example of a forming unit. The single-color units 21 other than the single-color unit 21G each form a toner image G with a non-flat toner NT (hereinafter, referred to as toner NT, see FIG. 5), which is described later, on the transfer belt TB. The toner MT and the toner NT of this exemplary embodiment each have, for example, negative polarity (average of charge amount distribution is negative). In the following description, the toners MT and NT are described as a toner T unless otherwise the toner MT and the toner NT are particularly required to be distinguished from one another.

Figure 2:
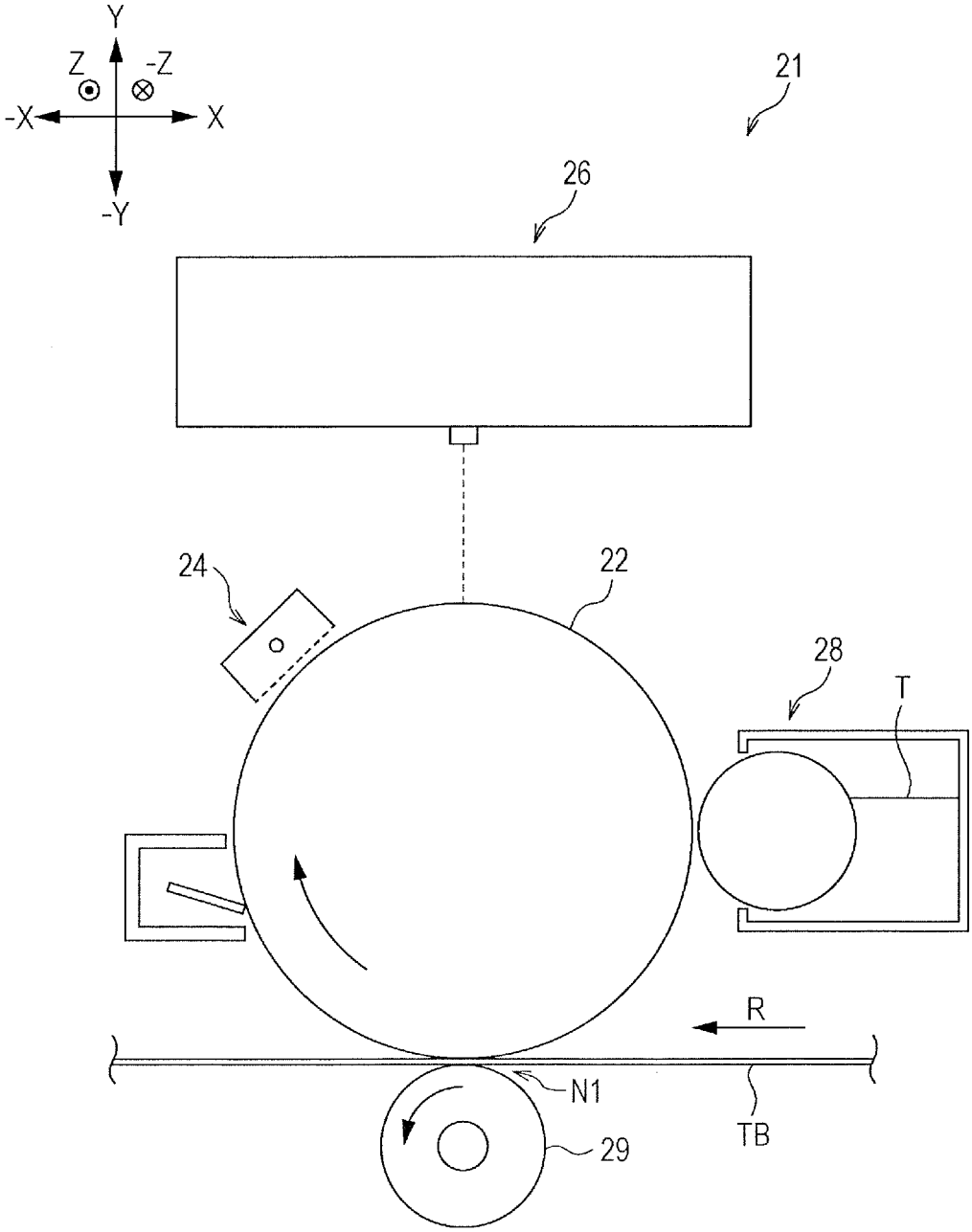
FIG. 2 is a schematic view (front view) of a toner image forming unit configuring the image forming apparatus according to the first exemplary embodiment.

As shown in FIGS. 1 and 2, each single-color unit 21 includes a cylindrical photoconductor 22, a charging device 24, an exposure device 26, a developing device 28, and a first transfer roller 29. The charging device 24 electrically charges the photoconductor 22, the exposure device 26 exposes the photoconductor 22 to light, the developing device 28 develops a toner image G, and the first transfer roller 29 first transfers the toner image G on the moving (circulating) transfer belt TB at a nip N1. Thus, the toner image forming unit 20 forms toner images G on the transfer belt TB. A first transfer voltage (voltage with positive polarity) is applied from the power supply PS to each first transfer roller 29, and hence the first transfer roller 29 first transfers a corresponding toner image G formed on the corresponding photoconductor 22, on the moving transfer belt TB at the corresponding nip N1. The exposure device 26 forms, for example, a latent image on the photoconductor 22 with an exposure dot corresponding to 1200 dpi×1200 dpi (about 21 μm×about 21 μm). In FIG. 1, the reference signs for the components of the single-color units 21 other than the single-color unit 21K are omitted.

Transfer Device

The transfer device 30 has a function of second transferring the toner images G of the respective colors formed by the respective single-color units 21 and first transferred at the nips N1, on a medium P transported to a nip N2 (described later). As shown in FIG. 1, the transfer device 30 includes the transfer belt TB, a driving roller 32, and a second transfer unit 34.

Transfer Belt and Driving Roller

The transfer belt TB is endless. The driving roller 32 is driven by a driving source (not shown), and moves the transfer belt TB in arrow R direction while rotating around its axis. The toner belt TB causes the toner images G of the respective colors formed by the respective single-color units 21 to reach the nip N2 while holding the toner images G of the respective colors on the outer periphery. The transfer belt TB is an example of a movable body.

Second Transfer Unit

Figure 3:
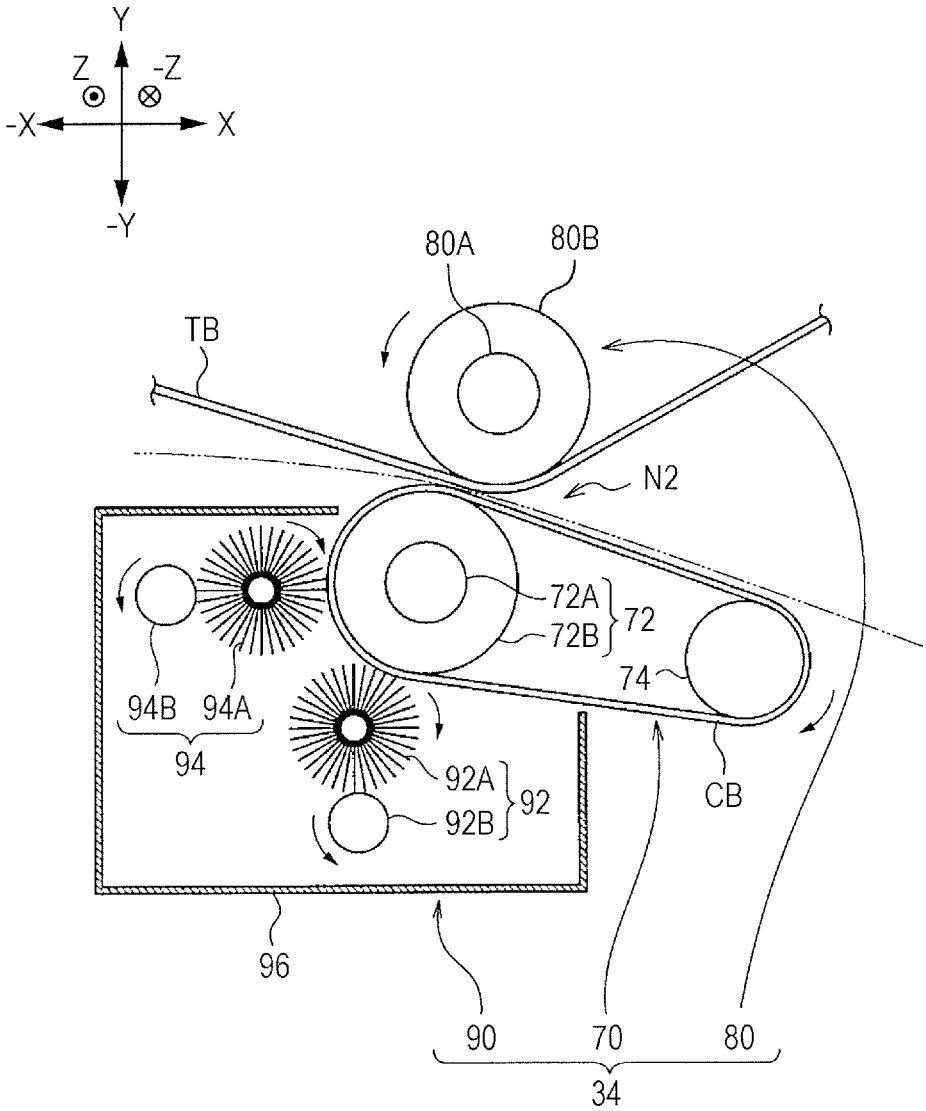
FIG. 3 is a schematic view of a peripheral area of a second transfer unit of a transfer device configuring the image forming apparatus according to the first exemplary embodiment.

The second transfer unit 34 has a function of second transferring the toner images G of the respective colors held on the transfer belt TB, on a medium P transported by the transport device 40 to the nip N2. As shown in FIGS. 1 and 3, the second transfer unit 34 includes a second transfer portion 70, a backup roller 80 (hereinafter, referred to as BUR 80), and a removing unit 90.

Second Transfer Unit and BUR

The second transfer portion 70 includes a conductive roller 72, a tension roller 74, and a conductive belt CB.

The conductive belt CB has a function of forming the nip N2 with the transfer belt TB while the conductive belt CB circulates, and transferring a toner image G on a medium P transported to the nip N2. The conductive belt CB is an example of a transfer unit. The conductive roller 72 includes a shaft 72A, and a cylindrical conductive layer 72B. The conductive roller 72 is driven by a driving source (not shown) and rotates around its axis. The conductive belt CB is endless, and is wound around the cylindrical conductive layer 72B. The tension roller 74 presses the conductive belt CB from the inner periphery side, and gives a tension to the conductive belt CB. With the above-described configuration, in the second transfer portion 70, the conductive belt CB circulates while the conductive roller 72 rotates around its axis. The shaft 72A of the conductive roller 72 is grounded.

As shown in FIGS. 1 and 3, the BUR 80 is arranged at the side opposite to the second transfer portion 70 (upper side) with the transfer belt TB interposed therebetween, and causes the conductive belt CB and the transfer belt TB to form the nip N2. The BUR 80 includes a shaft 80A, and a cylindrical conductive layer 80B. A voltage is applied from the power supply PS (see FIG. 1) to the shaft 80A of the BUR 80. To be specific, when a medium P passes through the nip N2, a second transfer voltage (voltage with negative polarity) is applied from the power supply PS to the BUR 80. Accordingly, the conductive belt CB forms an electric field that causes a toner image G to be second transferred on the medium P. Also, before and after the medium P passes through the nip N2, a voltage with positive polarity is applied from the power supply PS to the BUR 80. Accordingly, the conductive belt CB forms an electric field that causes the transfer belt TB to hold a fog toner, which is toner adhered to non-image areas where toner should not adhere at the nip N2, etc. at the nip N2.

Removing Unit

The removing unit 90 has a function of removing a toner T (the aforementioned fog toner etc.) adhering to the conductive belt CB. As shown in FIG. 3, the removing unit 90 includes a first removing portion 92, a second removing portion 94, and a housing 96. The first removing portion 92 and the second removing portion 94 are arranged in the housing 96.

The first removing portion 92 has a function of removing a toner T electrically charged with negative polarity. The first removing portion 92 includes a conductive brush 92A and a metal shaft 92B. The conductive brush 92A contacts (bites into) the conductive belt CB. The metal shaft 92B contacts the conductive brush 92A. The second removing portion 94 has a function of removing a toner T electrically charged with positive polarity. The second removing portion 94 is arranged at a part located downstream of the first removing portion 92 and located upstream of the nip N2 in a circulation direction of the conductive belt CB. The second removing portion 94 includes a conductive brush 94A and a metal shaft 94B. The conductive brush 94A contacts the conductive belt CB.

When the metal shaft 94B is driven by a driving source (not shown), the metal shaft 94B rotates counterclockwise in a view from the near side in the apparatus depth direction. Also, a torque is transmitted to the conductive brushes 92A and 94A, and the metal shaft 92B through a gear (not shown) meshing with a gear (not shown) provided at the metal shaft 94B. Consequently, the metal shaft 92B rotates counterclockwise, and the conductive brushes 92A and 94A rotate clockwise. As described above, in this exemplary embodiment, the conductive brushes 92A and 94A, and the metal shaft 92B are rotated when the metal shaft 94B rotates, and are stopped when the metal shaft 94B stops. In the image forming apparatus 10 of this exemplary embodiment, the metal shaft 94B rotates around its axis during a period of an image forming operation. Also, since a voltage with positive polarity is applied to the metal shaft 92B and a voltage with negative polarity is applied to the metal shaft 94B from the power supply PS, the first removing portion 92 and the second removing portion 94 respectively remove a toner T with negative polarity and a toner T with positive polarity.

Transport Device

The transport device 40 has a function of transporting a medium P. The transport device 40 transports a medium P in a transport direction CD (see FIG. 1).

Fixing Device

The fixing device 50 has a function of applying heat and pressure at a nip N3 to the toners T forming the toner images G of the respective colors second transferred on the medium P by the transfer device 30, and hence fixing the toners T to the medium P. The fixing device 50 includes a heating portion 50A and a pressing portion 50B.

Controller

The controller 60 has a function of controlling respective units other than the controller 60 configuring the image forming apparatus 10 (hereinafter, referred to as respective units other than the controller 60).

The controller 60 receives job data from an external device (not shown). The job data is an example of data. The controller 60 which has received the job data controls the respective units other than the controller 60 configuring the image forming apparatus 10 by following, for example, a flowchart in FIG. 7. If the controller 60 receives the job data and controls the respective units, the image forming apparatus 10 executes an image forming operation. The job data includes image data for allowing each single-color unit 21 to form a toner image G, the size of a medium P used for image formation, the width of the medium P used for image formation (the width of the medium P in a direction orthogonal to the transport direction CD of the medium P), data indicating the number of sheets, etc. The image data also includes data indicating an area coverage (%) for forming the toner image G (or image).

Figure 7:
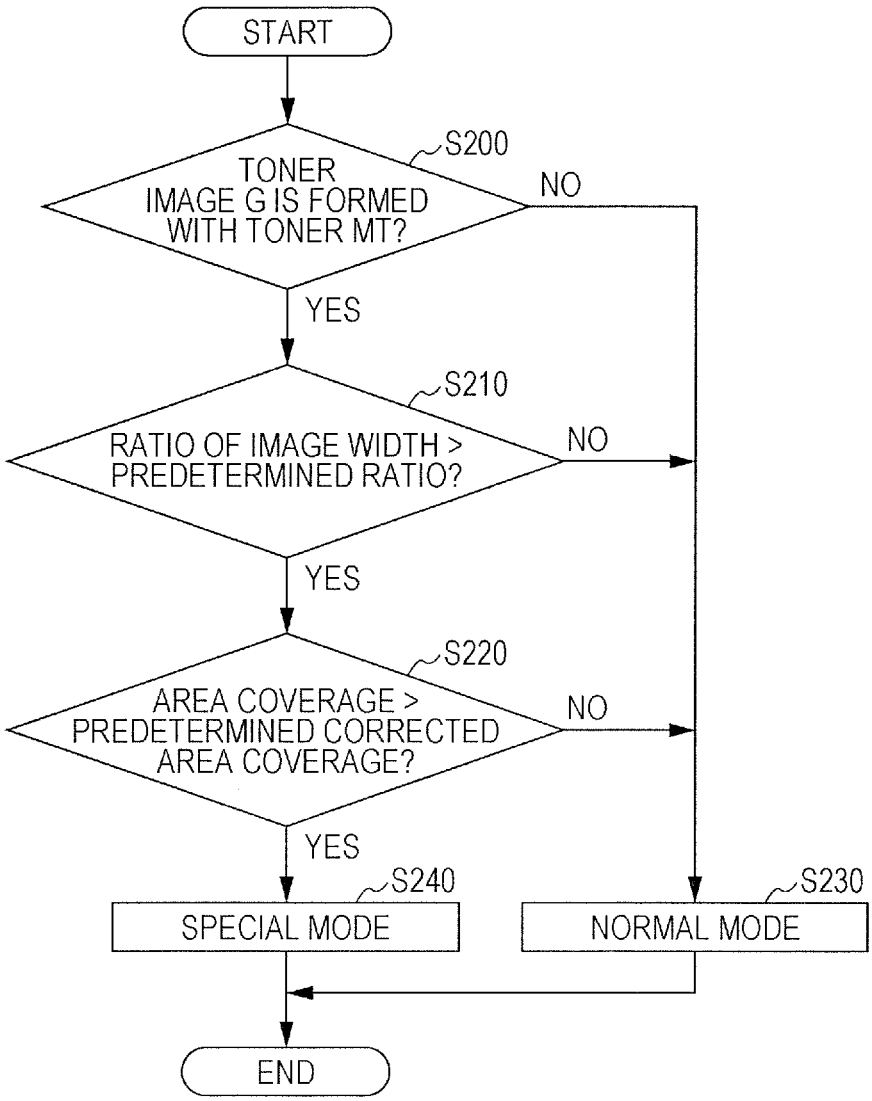
FIG. 7 is a flowchart of control that is executed during an operation of image formation by a controller configuring the image forming apparatus according to the first exemplary embodiment.

Hereinafter, a determining step S200, a determining step S210, and a determining step S220 in the control illustrated in the flowchart in FIG. 7 are described. Then, a normal mode (step S230) and a special mode (step S240) are described.

Determining Step S200

In the determining step S200, the controller 60 determines whether or not the controller 60 causes the single-color unit 21G to form a toner image G with the toner MT. Then, if the controller 60 determines YES in the determining step S200, the controller 60 executes determination in the determining step S210. If the controller 60 determines NO in the determining step S200, the controller 60 controls the respective units other than the controller 60 so that the image forming apparatus 10 executes the image forming operation in the normal mode (step S230).

Determining Step S210

In the determining step S210, the controller 60 determines whether or not a ratio R1 of the image width of the toner image G to be formed with the toner MT is larger than a predetermined ratio R2 (hereinafter, referred to as reference ratio R2). In this case, the image width is the maximum width among widths of the toner image G with the toner MT along the width direction of the medium P. The ratio R1 of the image width is the ratio of the maximum width among the widths of the toner image G with the toner MT along the width direction of the medium P with respect to the width of the medium P used for actual image formation. The reference ratio R2 is a ratio predetermined for the width of the medium P used for actual image formation. The predetermined ratio in this exemplary embodiment is, for example, ½ (50%) (see FIG. 8). In a different point of view, the controller 60 determines whether or not the image width of the toner image G to be formed with the toner MT is larger than a predetermined width (a width obtained by multiplying the width of the medium P used for actual image formation by the reference ratio R2). Then, if the controller 60 determines YES in the determining step S210, the controller 60 executes determination in the determining step S220. If the controller 60 determines NO in the determining step S210, the controller 60 controls the respective units other than the controller 60 so that the image forming apparatus 10 executes the image forming operation in the normal mode (step S230).

Determining Step S220

In the determining step S220, the controller 60 determines whether or not an area coverage of the toner image G to be formed with the toner MT (hereinafter, referred to as area coverage C1) is higher than a predetermined area coverage (hereinafter, referred to as reference area coverage C2). The area coverage of the toner MT represents the percentage of the number of pixels of the toner image G with the toner MT developed by the developing device 28 with respect to the total number of pixels included per unit area when the exposure dot formed by the exposure device 26 on the photoconductor 22 is one pixel. The reference area coverage C2 of this exemplary embodiment is, for example, 95% (see FIG. 8). If the controller 60 determines YES in the determining step S220, the controller 60 controls the respective units other than the controller 60 so that the image forming apparatus 10 executes the image forming operation in the special mode (step S240). If the controller 60 determines NO in the determining step S220, the controller 60 controls the respective units other than the controller 60 so that the image forming apparatus 10 executes the image forming operation in the normal mode (step S230).

Supplemental Explanation about Determining Steps S200, S210, and S220

As described above, if the controller 60 determines YES in the determining step S200, the controller 60 executes the determining step S210. If the controller 60 further determines YES in the determining step S210, the controller 60 executes the determining step S220. That is, if the controller 60 determines YES in the determining step S220, the data of the toner image G with the toner MT from the job data is included in an area A1 in FIG. 8. In this exemplary embodiment, if the data of the toner image G with the toner MT from the job data is included in the area A1 in FIG. 8, the reason for that the image forming apparatus 10 executes the image forming operation in the special mode is described in description for effects of this exemplary embodiment.

Step S230 (Normal Mode) and Step S240 (Special Mode)

The normal mode is a mode in which the controller 60 causes the respective single-color units 21 to form toner images G in accordance with the job data. In contrast, the special mode is a mode in which, if the controller 60 determines YES in the determining step S220 by following the control in FIG. 7, the controller 60 corrects (changes) the area coverage C1 from the job data to a corrected area coverage C3 lower than the area coverage C1, and causes the single-color unit 21G to form a toner image G with the toner MT. In this exemplary embodiment, the corrected area coverage C3 is, for example, equivalent to the reference area coverage C2.

The above description is for the general configuration of the image forming apparatus 10 of this exemplary embodiment.

Toner

Flat Toner (Toner MT)

Figure 4:
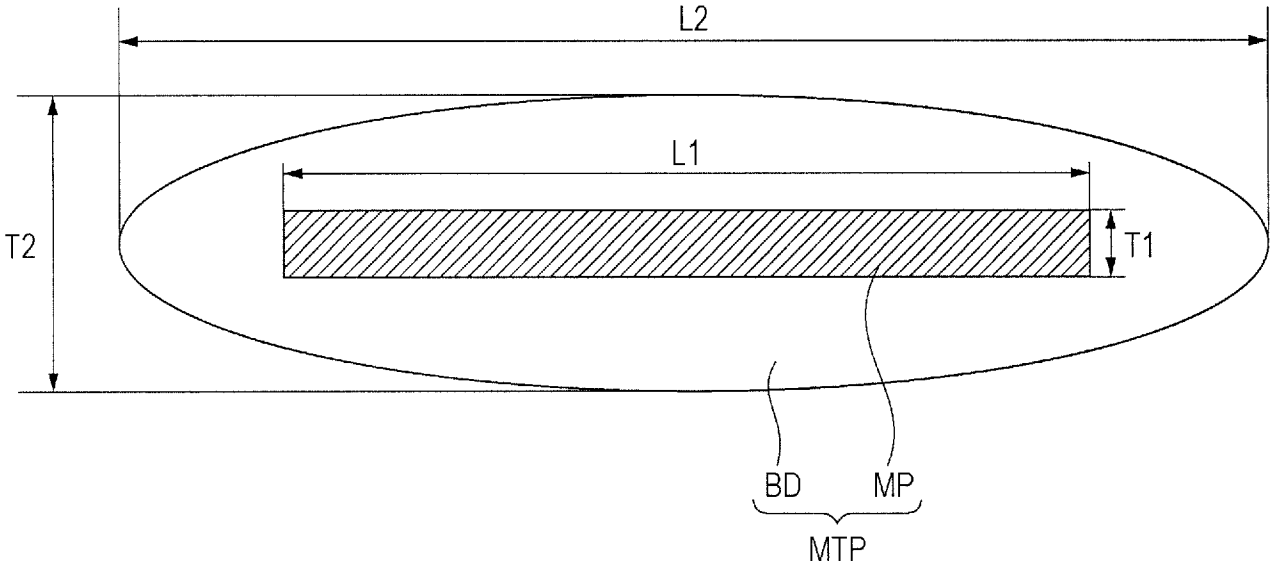
FIG. 4 is a schematic view (cross-sectional view) of a toner particle of a flat toner that is used by the image forming apparatus according to the first exemplary embodiment.

As shown in FIG. 4, a toner particle MTP configuring the toner MT contains a metal pigment MP and a binder BD. The binder BD covers the metal pigment MP. The metal pigment MP is flat or substantially flat. To be specific, the metal pigment MP has a long-axis length L1, for example, in a range from 5 μm to 12 μm, and a thickness T1, for example, in a range from 0.01 μm to 0.5 μm. In this case, the long-axis length L1 represents a length of a portion with the largest length of the metal pigment MP when the metal pigment MP is viewed in a direction orthogonal to the thickness direction of the metal pigment MP. The toner particle MTP of this exemplary embodiment has a long-axis length L2, for example, in a range from 7 μm to 20 μm, and a thickness T2, for example, in a range from 1 μm to 3 μm. In this case, the long-axis length L2 represents a length of a portion with the largest length of the toner particle MTP when the toner particle MTP is viewed in a direction orthogonal to the thickness direction of the toner particle MTP. As described above, the toner particle MTP of this exemplary embodiment is a toner particle having relationships that (long-axis length L1)/(thickness T1) of the contained metal pigment MP is, for example, in a range from 10 to 1200, and (long-axis length L2)/(thickness T2) of the toner particle MTP is, for example, in a range from 2.3 to 20 (the toner MT of this exemplary embodiment being a group of the toner particles MTP having the above-described relationships). As described above, the toner MT of this exemplary embodiment is gold color. The gold color is made by using, for example, aluminum for the metal pigment MP configuring the toner particle MTP, and dispersing, for example, a pigment of yellow (Y) in the binder BD.

Non-flat Toner (Toner NT)

Figure 5:
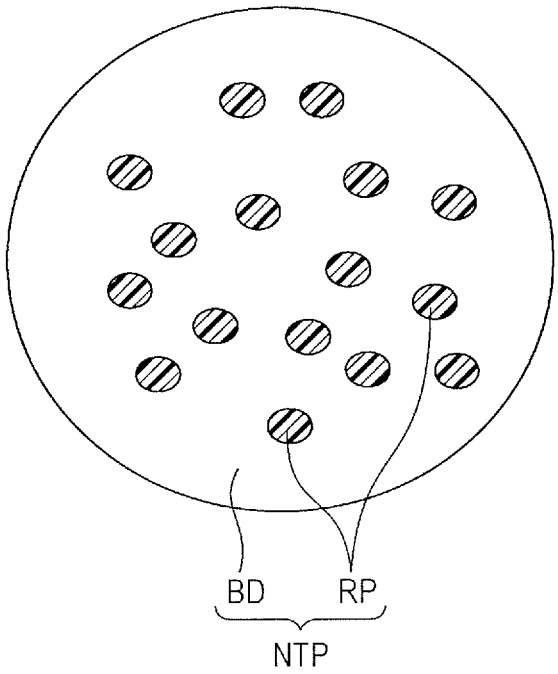
FIG. 5 is a schematic view (cross-sectional view) of a toner particle of a non-flat toner that is used by the image forming apparatus according to the first exemplary embodiment.

As shown in FIG. 5, a toner particle NTP configuring the toner NT contains, for example, a resin pigment RP and a binder BD. Also, the toner particle NTP is not flat. To be specific, the toner particle NTP of this exemplary embodiment represents a toner particle having relationships that (long-axis length)/(thickness) of the contained resin pigment RP is, for example, smaller than 10, and (long-axis length)/(thickness) of the toner particle NTP is, for example, smaller than 2.3. Also, the circularity of the toner particle NTP of this exemplary embodiment when the toner particle NTP is projected on a flat plane is, for example, 0.90 or larger. Thus, the toner particle NTP (the toner NT) of this exemplary embodiment is a non-flat toner particle (a toner).

The above description is for the toners MT and NT that are used by the image forming apparatus 10 of this exemplary embodiment.

Supplemental Explanation

Supplemental explanation is given below for the configuration of the image forming apparatus 10 of this exemplary embodiment.

Supplemental Explanation 1

Figure 6A:
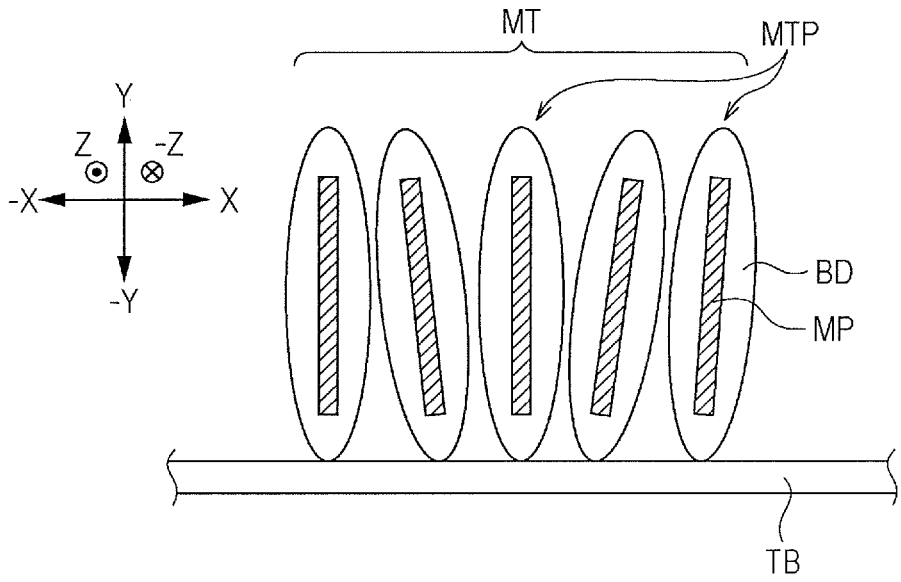
FIGS. 6A and 6B are each an illustration showing a flat toner held on a transfer belt of the image forming apparatus according to the first exemplary embodiment, FIG. 6A being a schematic view showing a flat toner configuring a toner image within a dotted-line area 6A in FIG. 1, FIG. 6B being a schematic view showing a flat toner configuring a toner image within a dotted-line area 6B in FIG. 1.
Figure 6B:
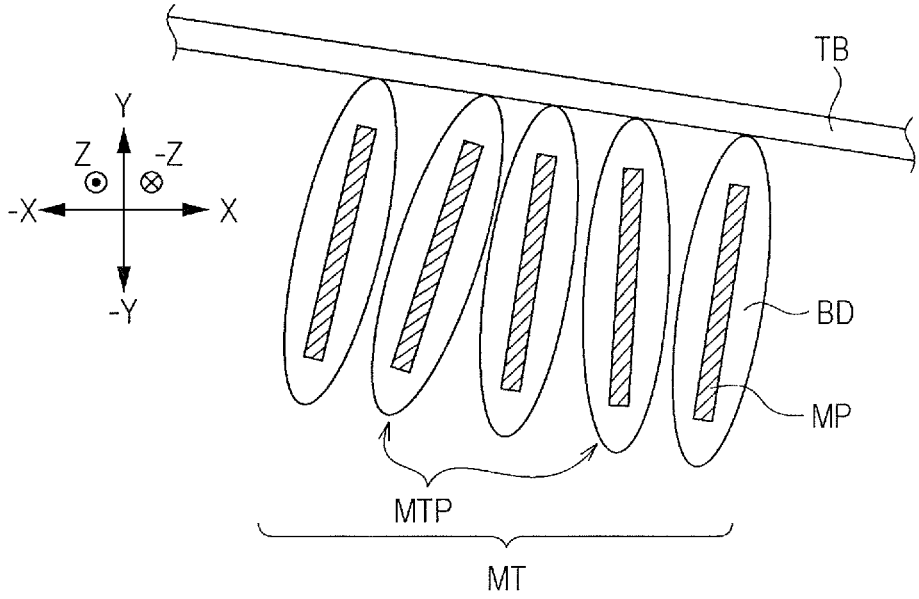

As shown in each of FIGS. 6A and 6B, the toner MT is held at the transfer belt TB in a state (a standing state) in which the long axis (the axis in the longitudinal direction) of the toner MT is along a direction substantially orthogonal to the outer periphery of the transfer belt TB while the toner MT moves with the transfer belt TB at a part other than the nip N1 or N2. This may be expectedly because the toner MT is polarized in the direction along the long-axis direction of the toner MT. Also, it may be considered that the toner MT adhering to the transfer belt TB in the standing state falls to the transfer belt TB expectedly because the toner MT is pinched by the photoconductor 22 and the transfer belt TB at the nip N1 and is pinched by the conductive belt CB of the second transfer portion 70 and the transfer belt TB at the nip N2.

Supplemental Explanation 2

As described above, in the image forming apparatus 10 of this exemplary embodiment, when a toner image G is formed by using the single-color unit 21G, an image using the flat metal pigment MT as a coloring matter is formed. When an image is formed by using the toner MT configured of the toner particle MTP containing the flat metal pigment MP, the image reflects light and hence generates metallic glossiness.

Image Forming Operation of Image Forming Apparatus

An image forming operation of the image forming apparatus 10 of this exemplary embodiment is described with reference to the drawings. In the following description, a basic operation of the image forming apparatus 10 is described first, and an operation executed every different job data received from an external device (not shown) is described next. In this case, the basic operation of the image forming apparatus 10 represents an operation that is executed commonly even if job data is different.

Basic Operation

When the controller 60 receives job data from an external device (not shown), the controller 60 activates the toner image forming unit 20, the transfer device 30, and the fixing device 50 which are the respective units other than the controller 60.

The controller 60 causes the charging devices 24 to respectively electrically charge the photoconductors 22, causes the exposure devices 26 to respectively expose the photoconductors 22 to light, causes the developing devices 28 to respectively develop toner images G, and causes the first transfer rollers 29 to respectively first transfer the toner images G on the moving (circulating) transfer belt TB at the nips N1. Also, at first transfer, the controller 60 causes the power supply PS to apply first transfer voltages respectively to the first transfer rollers 29. In this way, the controller 60 causes the toner image forming unit 20 to form the respective toner images G on the transfer belt TB.

Also, the controller 60 drives the driving source (not shown) of the second transfer unit 34 (to cause the conductive belt CB to circulate, and to cause the conductive brushes 92A and 94A to rotate around their axes) and heats the heating portion 50A of the fixing device 50.

Then, controller 60 causes the transport device 40 to transport a medium P to N2 in synchronization with a timing at which the respective toner images G on the transfer belt TB reach the nip N2 together with the transfer belt TB. The controller 60 causes the power supply PS to apply a second transfer voltage to the shaft 80A of the BUR 80. Consequently, the toner images G on the transfer belt TB are second transferred on the medium P passing through the nip N2.

Then, the controller 60 causes the transport device 40 to transport the medium P to the nip N3 of the fixing device 50. The controller 60 causes the heating portion 50A to heat the toner T configuring the toner images G second transferred on the medium P and causes the pressing portion 50B to press the toner T. Consequently, the toner images G on the medium P is fixed to the medium P. The medium P with the toner images G fixed (the medium P with an image formed) is output to the outside of the image forming apparatus 10 by the transport device 40, and the image forming operation of the image forming apparatus 10 is ended.

The toner T adhering to the conductive belt CB (the aforementioned fog toner etc.) circulates together with the conductive belt CB, and is removed from the conductive belt CB by the removing unit 90.

The above description is for the basic operation of the image forming apparatus 10.

Operation of Each Job Data

Next, an operation executed every different job data received from the external device (not shown) is described with reference to FIG. 7.

If Job Data for Forming Toner Image G with Toner MT is not Included

In this case, the controller 60 determines NO in the determining step S200, and controls the respective units other than the controller 60 in the normal mode according to step S230. Image formation on a medium P, which is requested for image formation, is executed by the image forming apparatus 10 and the image forming operation is ended.

If Job Data for Forming Toner Image G with Toner MT is Included

In this case, the controller 60 determines YES under the condition in the determining step S200, and makes determination in the determining step S210.

In this case, if the controller 60 determines NO in the determining step S210, the controller 60 controls the respective units other than the controller 60 in the normal mode according to step S230. Image formation on a medium P, which is requested for image formation, is executed by the image forming apparatus 10 and the image forming operation is ended.

If the controller 60 determines YES in the determining step S210, the controller 60 executes determination in the determining step S220.

If the controller 60 determines NO in the determining step S220, the controller 60 controls the respective units other than the controller 60 in the normal mode according to step S230. Image formation on a medium P, which is requested for image formation, is executed by the image forming apparatus 10 and the image forming operation is ended.

In contrast, if the controller 60 determines YES in the determining step S220, the controller 60 controls the respective units other than the controller 60 in the special mode according to step S240. To be specific, the controller 60 corrects the area coverage C1 from the job data to the corrected area coverage C3, and causes the single-color unit 21G to form a toner image G with the toner MT. Image formation on a medium P, which is requested for image formation, is executed by the image forming apparatus 10 and the image forming operation is ended.

Effect

Then, effects of this exemplary embodiment are described.

First, effects of this exemplary embodiment are described with reference to the drawings. In the following description, when effects of this exemplary embodiment are compared with effects of comparative exemplary embodiments (first to third comparative exemplary embodiments), and when the components used in this exemplary embodiment are used in the comparative exemplary embodiments, the reference signs of the components are used without being changed.

First Effect

For a first effect, the image forming apparatus 10 of this exemplary embodiment is described in comparison with an image forming apparatus (not shown) of a first comparative exemplary embodiment described below.

Figure 8:
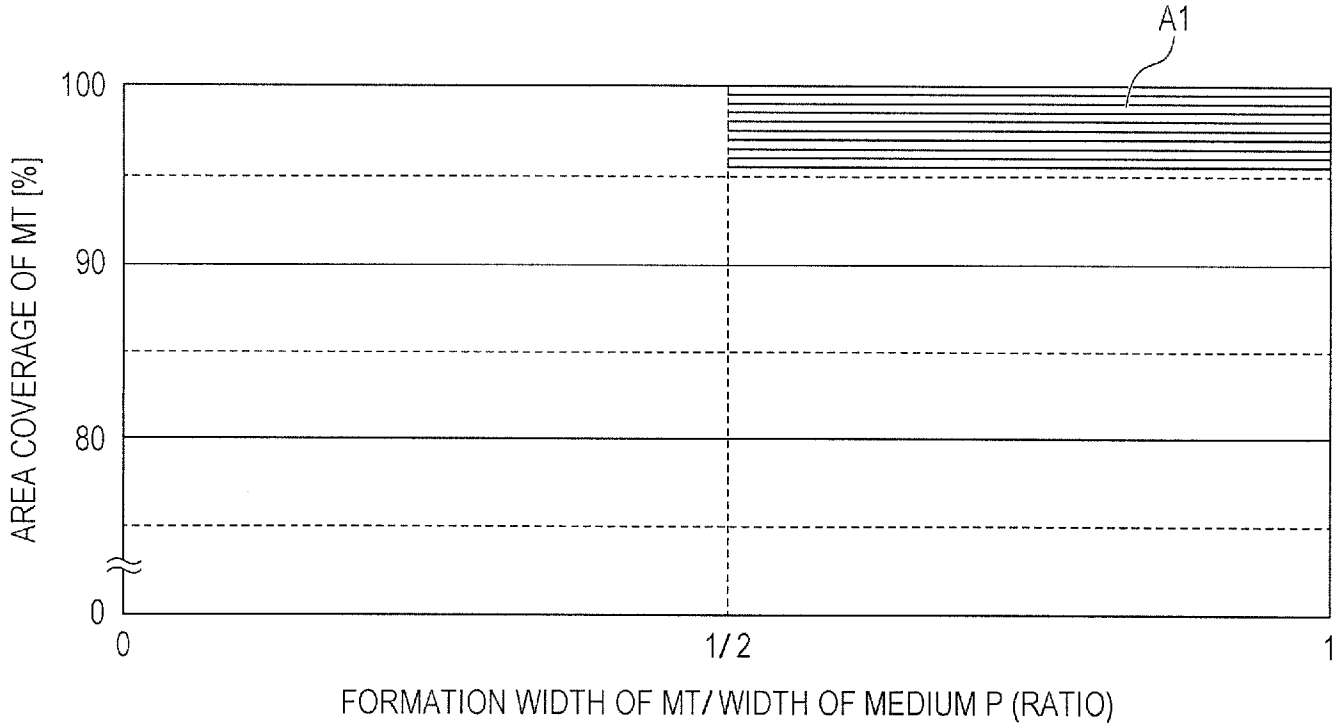
FIG. 8 is a schematic view showing a predetermined condition of the controller in the flowchart in FIG. 7, in the image forming apparatus according to the first exemplary embodiment.

When the image forming apparatus of the first comparative exemplary embodiment causes the single-color unit 21G to form a toner image G with the toner MT, the image forming apparatus of the first comparative exemplary embodiment executes an image forming operation in a mode similar to the normal mode of this exemplary embodiment. That is, if data of a toner image G with the toner MT from job data is included in the area A1 in FIG. 8, the controller of the image forming apparatus of the first comparative exemplary embodiment causes the single-color unit 21G to form the toner image G with the toner MT with the area coverage C1 from the job data. In other words, the controller of the image forming apparatus of the first comparative exemplary embodiment has a similar configuration to that of the image forming apparatus 10 of this exemplary embodiment except that the determining step S210 or S220 in the flowchart in FIG. 8 is not provided with regard to the image forming operation of the image forming apparatus 10 according to this exemplary embodiment. The image forming apparatus of the first comparative exemplary embodiment has a similar configuration to that of the image forming apparatus 10 of this exemplary embodiment except the above-described point. Also, the image forming operation of the image forming apparatus of the first comparative exemplary embodiment is similar to that of the image forming apparatus 10 of this exemplary embodiment except that the controller 60 does not execute determination in the determining step S210 or the determining step S220 with regard to the image forming operation of the image forming apparatus 10 according to this exemplary embodiment.

Figure 11A:
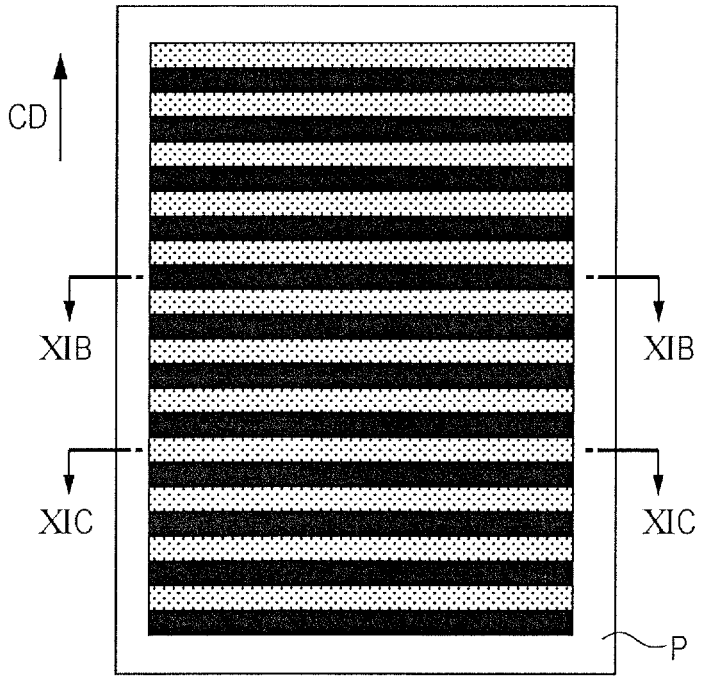
FIG. 11A is a schematic view showing an image on a medium formed by an image forming apparatus according to a comparative exemplary embodiment.
Figure 11B:
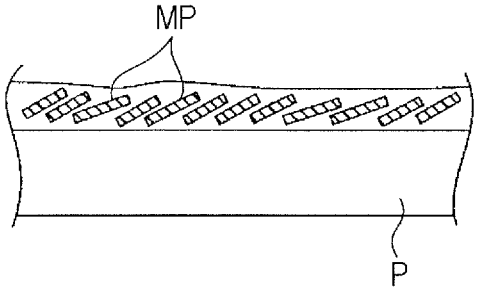
FIG. 11B is a partial cross-sectional view taken along line XIB-XIB in FIG. 11A.
Figure 11C:
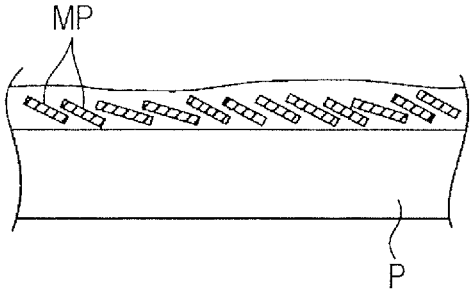
FIG. 11C is a partial cross-sectional view taken along line XIC-XIC in FIG. 11A.
Figure 12:
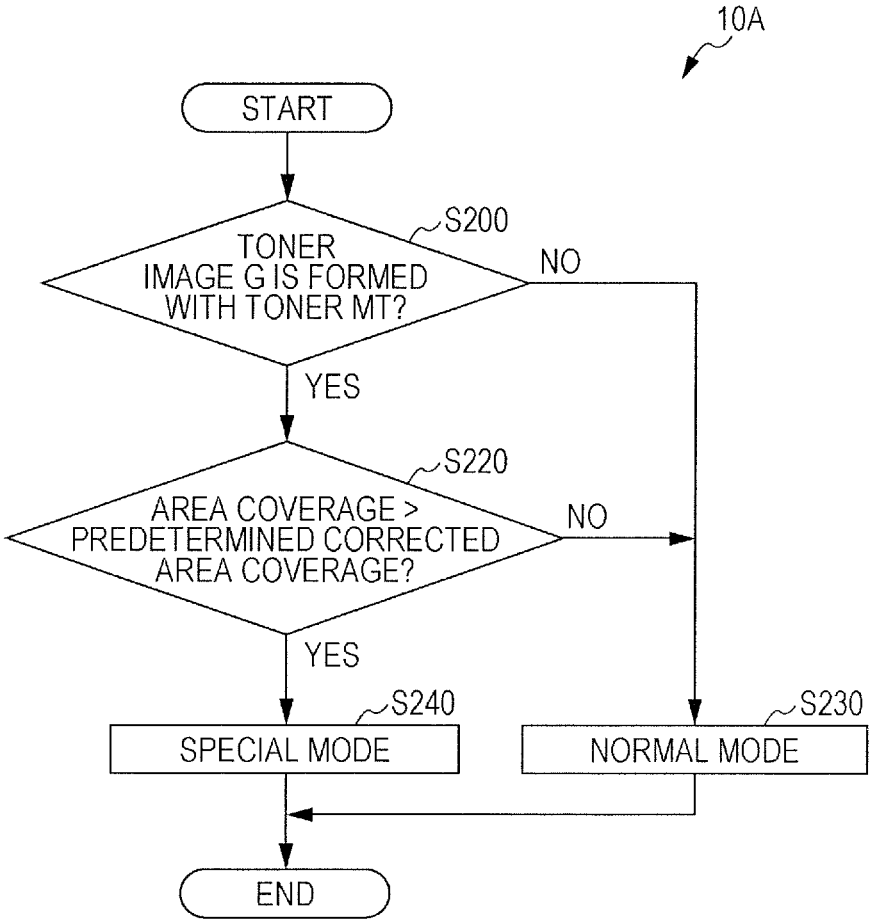
FIG. 12 is a flowchart of control that is executed during an operation of image formation by a controller configuring an image forming apparatus according to another exemplary embodiment.

In the image forming apparatus of the first comparative exemplary embodiment, the controller drives the driving source (not shown) of the metal shaft 94B configuring the second transfer unit 34 during a period of the image forming operation similarly to the image forming apparatus 10 of this exemplary embodiment. Accordingly, the metal shaft 94B rotates around its axis, the conductive roller 72 vibrates in the apparatus depth direction and the apparatus height direction by the rotation of gears (not shown) of the conductive brushes 92A and 94A and the metal shafts 92B and 94B. The conductive belt CB also vibrates in the apparatus depth direction and the apparatus height direction by the vibration of the conductive roller 72. Consequently, in the case of the first comparative exemplary embodiment, the toner MT adhering to the transfer belt TB in the standing state falls to the transfer belt TB alternately at the near side or the far side in the apparatus depth direction (one side or the other side in the width direction of the medium P), and is second transferred on the medium P in synchronization with the passing timing. Then, as shown in FIGS. 11A to 11C, regarding the toner image G (image) whose toner MT configuring the second transferred toner image G is fixed, the flat metal pigment MP falls to the medium P alternately at the one side or the other side in the width direction of the medium P for a vibration period of the conductive roller 72. If the data of the toner image G with the toner image MT is included in the area A1 in FIG. 8, the posture of the flat metal pigment MP periodically varies in the image.

Figure 9:
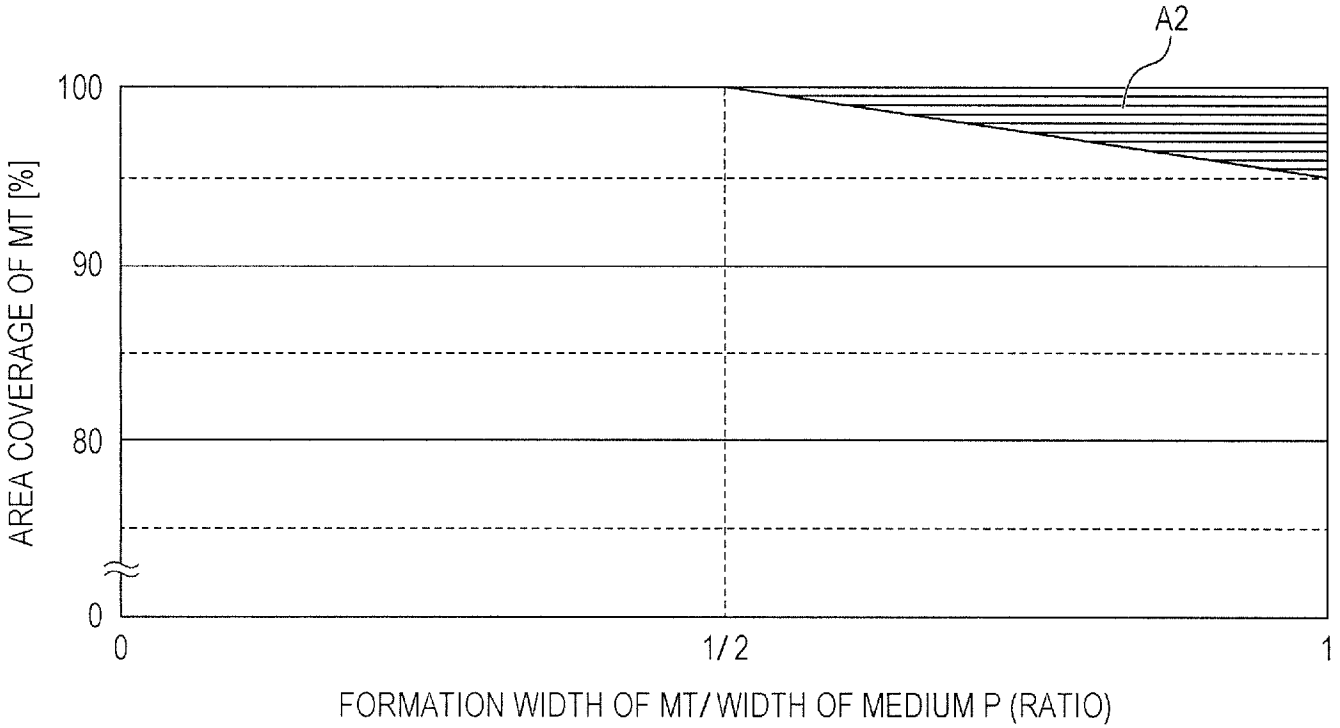
FIG. 9 is a graph showing a test result that serves as the basis of the predetermined condition in FIG. 8.
Figure 10:
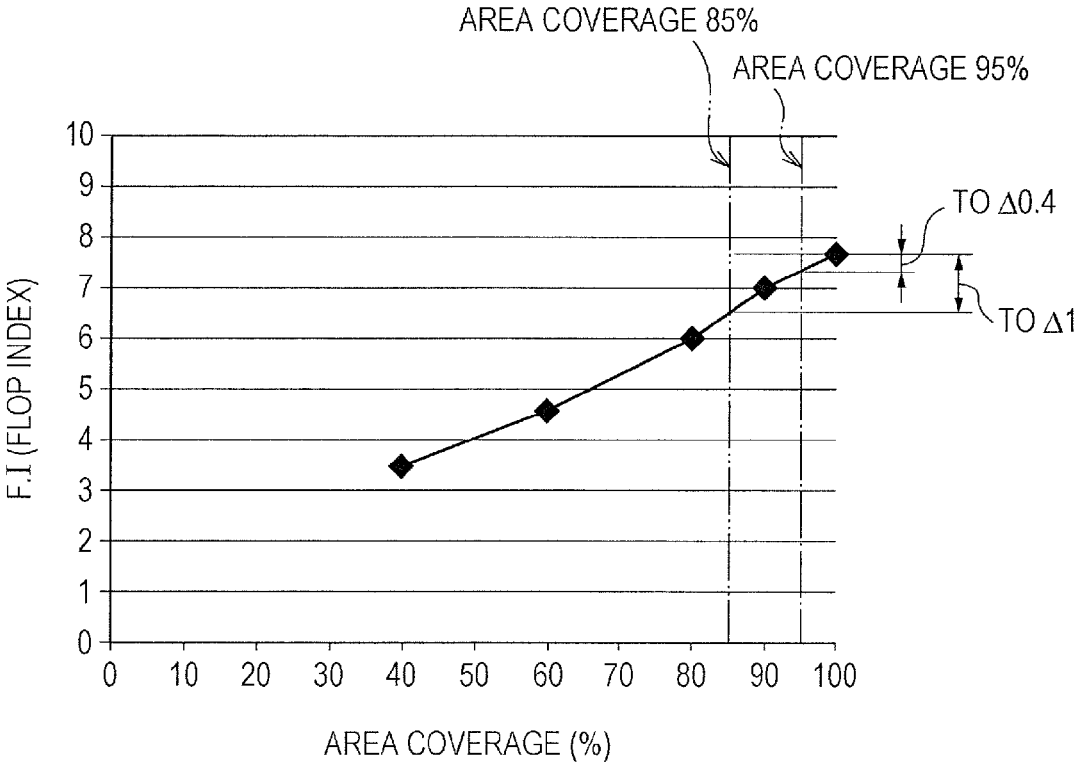
FIG. 10 is a graph showing a test result that serves as the basis of the predetermined condition in FIG. 8.

In this case, it may be expectedly considered that the toner MT more likely slips between the transfer belt TB and the medium P at the nip N2 as the width of the toner image G to be formed with the toner MT is larger and as the area coverage C1 of the toner MT is higher. As described above, since the conductive belt CB vibrates in the apparatus depth direction and the apparatus height direction, it may be expectedly considered that the toner MT more likely slips at the nip N2 and falls in the apparatus depth direction (vibration direction of the conductive belt CB) as the width of the toner image G to be formed with the toner MT is larger and the area coverage C1 of the toner MT is higher. The inventor of this application found that, if the data of the toner image G with the toner MT is in an area A2 in FIG. 9, an image with a small periodical variation in posture of the flat metal pigment MP, or in other words, an image in which arrangement unevenness of the flat metal pigment MP is more likely visually recognized. Therefore, in this exemplary embodiment, the area A1 in FIG. 9 includes the area A2 in FIG. 10.

In the image forming apparatus 10 of this exemplary embodiment, as shown in FIG. 7, if the controller 60 determines YES in the determining step S220, the controller 60 controls the respective units other than the controller 60 so that the image forming apparatus 10 executes the image forming operation in the special mode according to step S240. That is, if the data of the toner image G with the toner MT from the job data is included in the area A1 in FIG. 8, the controller 60 according to this exemplary embodiment controls the respective units other than the controller 60 so that the image forming apparatus 10 executes the image forming operation in the special mode according to step S240. To be specific, the controller 60 of this exemplary embodiment corrects the area coverage C1 from the job data to the corrected area coverage C3, and causes the single-color unit 21G to form a toner image G with the toner MT.

Accordingly, with the image forming apparatus 10 of this exemplary embodiment, if the data of the toner image with the toner MT from the job data is included in the area A1 in FIG. 8, an image with a smaller periodical variation in posture of the flat metal pigment MP is formed as compared with the image forming apparatus that executes the image forming operation in the normal mode.

In the image forming apparatus 10 of this exemplary embodiment, as shown in FIG. 7, if the controller 60 determines NO in any of the determining step S200, the determining step S210, and the determining step S220, the controller 60 controls the respective units other than the controller 60 so that the image forming apparatus 10 executes the image forming operation in the normal mode according to step S230. That is, if the data of the toner image G with the toner MT from the job data is not included in the area A1 in FIG. 8, the controller 60 according to this exemplary embodiment controls the respective units other than the controller 60 so that the image forming apparatus 10 executes the image forming operation in the normal mode according to step S230. Hence, if the controller 60 of this exemplary embodiment determines NO in the determining step S210 or the determining step S220, the controller 60 causes the single-color unit 21G to form the toner image G of the toner MT with the area coverage C1 from the job data.

As described above, if the controller 60 of this exemplary embodiment determines YES in the determining step S220, the controller 60 changes the area coverage C1 to the corrected area coverage C3 and executes image formation. Accordingly, the image forming apparatus 10 of this exemplary embodiment forms an image to be actually formed on a medium P with a lower area coverage than the area coverage C1 from the job data. However, the inventor of this application found that, if an image with the area coverage C1 of 85% of the toner image G with the toner MT is compared with an image with the area coverage C1 of 100%, a difference Δ in flop index (F.I.) is 1 or smaller, and the difference Δ is at a level that is hardly visually recognized by a person who has ordinary vision. In particular, if an image with an area coverage of 95%, which is the corrected area coverage C3 in this exemplary embodiment, is compared with an image with an area coverage of 100%, which is higher than the corrected area coverage C3, the difference Δ of F.I. is about 0.4. Therefore, in this exemplary embodiment, the corrected area coverage C3 is, for example, 95%. F.I. is measured under ASTM E2194. To be specific, a medium P on which a solid-fill image is formed uses OS coated paper (manufactured by Fuji Xerox InterField Co., Ltd., and having a basis weight of 127 [g/m$^2$] and a smoothness of 4735 [sec] measured under JISP 8119). Then, a solid-fill image is formed with the toner MT on a medium P by using the image forming apparatus 10. Also, when the image forming operation is executed, the temperature of the heating portion 50A of the fixing device 50 is 155° C.

Second Effect

For a second effect, the image forming apparatus 10 of this exemplary embodiment is described in comparison with an image forming apparatus 10A of a second comparative exemplary embodiment described below.

The image forming apparatus 10A of the second comparative exemplary embodiment differs from the image forming apparatus 10 of this exemplary embodiment (see FIG. 7) in that the determining step S210 is not provided. Hence, the controller 60 of the second comparative exemplary embodiment does not determine whether or not the ratio R1 of the image width of a toner image G to be formed with the toner MT is larger than the reference ratio R2. If the area coverage C1 of the toner image G to be formed with the toner MT is higher than the reference area coverage C2 regardless of the ratio R1 of the image width of the toner image G to be formed with the toner MT, the controller 60 of the second comparative exemplary embodiment controls the respective units other than the controller 60 in the special mode. The image forming apparatus 10A of the second comparative exemplary embodiment has a similar configuration to that of the image forming apparatus 10 of the first exemplary embodiment except the above-described point. Also, the image forming operation of the image forming apparatus 10A of the second comparative exemplary embodiment is similar to that of the image forming apparatus 10 of this exemplary embodiment except that the controller 60 does not execute determination in the determining step S210 with regard to the image forming operation of the image forming apparatus 10 according to this exemplary embodiment. It is to be noted that the image forming apparatus 10A of the second comparative exemplary embodiment pertains to the technical scope of the invention.

If data of a toner image G with the toner MT from job data is included in the area A1 in FIG. 8, the image forming apparatus 10A of the second comparative exemplary embodiment forms an image with a smaller periodical variation in posture of the flat metal pigment MP as compared with the image forming apparatus that executes the image forming operation in the normal mode. However, the image forming apparatus 10A of the second comparative exemplary embodiment executes the image forming operation in the special mode if the ratio R1 of the image width of the toner image G with the toner MT from the job data is equal to or smaller than the reference ratio R2 and if the area coverage C1 is higher than the reference area coverage C2. That is, the image forming apparatus 10A of the second comparative exemplary embodiment forms an image with the corrected area coverage C3 lower than the area coverage C1 even when the area coverage C1 is higher than the reference area coverage C2 but the image after fixing does not have a noticeably large periodical variation in posture of the flat metal pigment MP.

In contrast, as shown in FIG. 7, in the image forming apparatus 10 of this exemplary embodiment, if the ratio R1 of the image width of the toner image G with the toner MT from the job data is equal to or smaller than the reference ratio R2 and if the area coverage C1 is higher than the reference area coverage C2, the controller 60 determines YES in the determining steps S210 and S220 and executes the image forming operation in the normal mode. Accordingly, if the area coverage C1 from the job data is higher than the reference area coverage C2 and the ratio R1 of the image width of the toner image G with the toner MT is equal to or smaller than the reference ratio R2, the image forming apparatus 10 of this exemplary embodiment does not execute the image forming operation in the special mode. That is, the image forming apparatus 10 of this exemplary embodiment forms an image with the area coverage C1 without correcting the area coverage C1 to the lower corrected area coverage C3 if the area coverage C1 is higher than the reference area coverage C2 but the image after fixing does not have a noticeably large periodical variation in posture of the flat metal pigment MP.

Hence, with the image forming apparatus 10 of this exemplary embodiment, if an image of data in which the area coverage C1 is higher than the reference area coverage C2 and if the ratio R1 of the image width is equal to or smaller than the reference ratio R2, the image may be formed with the area coverage C1.

Third Effect

For a third effect, the image forming apparatus 10 of this exemplary embodiment is described in comparison with an image forming apparatus (not shown) of a third comparative exemplary embodiment described below.

In the image forming apparatus of the third comparative exemplary embodiment, the ratio R1 of the image width is a ratio of the width by which a toner image G is actually formed with respect to the width by which a toner image G is formable on the transfer belt TB (hereinafter, referred to as formable width), and the reference, and the reference ratio R2 is a ratio of a predetermined width with respect to the formable width (for example, 50%). The controller 60 of the image forming apparatus of the third comparative exemplary embodiment executes the determining step S210 while the ratio R1 of the image width and the reference ratio R2 are used for a ratio with respect to the formable width on the transfer belt TB. The image forming apparatus of the third comparative exemplary embodiment has a similar configuration to that of the image forming apparatus 10 of the first exemplary embodiment except the above-described point. Also, the image forming operation of the image forming apparatus of the third comparative exemplary embodiment is similar to that of the image forming apparatus 10 of this exemplary embodiment except for the above-described point with regard to the image forming operation of the image forming apparatus 10 according to this exemplary embodiment. It is to be noted that the image forming apparatus of the third comparative exemplary embodiment pertains to the technical scope of the invention.

The image forming apparatus of the third comparative exemplary embodiment may not execute the special mode even if data of a toner image G with the toner MT is included in the area A1 in FIG. 8 but the data is equal to or smaller than the reference ratio R2 of the third comparative exemplary embodiment. In this case, the image forming apparatus of the third comparative exemplary embodiment may form an image with a large periodical variation in posture of the flat metal pigment MT.

In contrast, the controller 60 of the image forming apparatus 10 of this exemplary embodiment executes the determining step S210 by using the ratio R1 of the image width and the reference ratio R2 for the ratio with respect to the width of the medium P used for actual image formation. Accordingly, the controller 60 of this exemplary embodiment may change the ratio R1 and the reference ratio R2 in accordance with the width of the medium P used for actual image formation.

Thus, with the image forming apparatus 10 of this exemplary embodiment, as compared with the image forming apparatus that does not change the predetermined width in accordance with the width of the medium P actually used for image formation, an image with a small periodical variation in posture of the flat metal pigment may be formed in accordance with the width of the medium P to be used.

Supplemental Explanation

A method of measuring whether or not the area coverage C1 from the job data is corrected to the corrected area coverage C3 is described.

Preparing Process

In a preparing process, plural pieces of job data of different area coverages C1 (data of solid-fill images) are prepared, and an image forming apparatus serving as a measurement subject forms an image based on each piece of the job data. At least a single piece of data of the toner MT from the plural pieces of job data is included in the area A1 in FIG. 8. Also, at least a single piece of data of the toner MT from the plural pieces of job data is not included in the area A1 in FIG. 8. The image forming apparatus forms an image in accordance with each piece of job data, image samples are prepared, and the preparing process is ended.

Determining Process

In a determining process, an image of each image sample is enlarged and observed. To be specific, observation is executed by using a microscope. Then, the area coverage of the image sample is compared with the area coverage C1 of the job data from the result of observation of each image sample. As the result of comparison, if the area coverage of the image sample is lower than the area coverage C1 of the job data, it is determined that the area coverage C1 is corrected. Then, the reference area coverage C2 is obtained by observing plural image samples of different area coverages C1 by comparing them with each other and observing them, and it is determined whether or not the image forming apparatus implements the invention. Alternatively, without use of an image sample, a toner image G on a medium P after second transfer but before fixing may be observed.

The invention has been described above in detail based on the specific exemplary embodiment; however, the invention is not limited to the above-described exemplary embodiment and other exemplary embodiment may be employed within the scope of the technical idea of the invention.

For example, in the image forming apparatus 10 of the first exemplary embodiment, the controller 60 determines the determining step S200, the determining step S210, and the determining step S220, and executes the image forming operation (mode) in accordance with the determination. However, the mode executed in accordance with each determination is merely an example, and the image forming apparatus 10 of the first exemplary embodiment may include other mode. The image forming apparatuses 10A and 10B of other exemplary embodiments may be configured similarly.

Also, the toner MT used by the image forming apparatus 10 of the first exemplary embodiment is gold color. However, the toner MT may not be gold color as long as the toner MT is a flat toner containing a flat metal pigment. For example, the toner MT may be silver color. The image forming apparatuses 10A and 10B of other exemplary embodiments may be configured similarly.

Also, as shown in FIG. 1, in the image forming apparatus 10 of the first exemplary embodiment, the single-color unit 21G that uses the toner MT is arranged at the most upstream side in the moving direction of the transfer belt TB in the toner image forming unit 20. However, the single-color unit 21G may not be arranged at the most upstream side in the moving direction of the transfer belt TB as long as the toner image forming unit 20 includes the single-color unit 21G.

Also, in the image forming apparatus 10 of the first exemplary embodiment, the second transfer voltage is applied to the BUR 80 and the conductive roller 72 configuring the second transfer portion 70 is grounded. However, the second transfer voltage may be applied to the conductive roller 72 and the BUR 80 may be grounded.

Also, in the image forming apparatus 10 of the first exemplary embodiment, the conductive belt CB is an example of the transfer unit. However, instead of providing the conductive belt CB and the tension roller 74 like the second transfer portion 70, for example, the nip N2 may be formed by the conductive roller 72 and the transfer belt TB. In this case, the conductive roller 72 serves as an example of the transfer unit. The image forming apparatuses 10A and 10B of other exemplary embodiments may be configured similarly.

Also, in the image forming apparatus 10 of the first exemplary embodiment, the removing unit 90 configuring the second transfer unit 34 includes the first removing portion 92 and the second removing portion 94. However, one of the first removing portion 92 and the second removing portion 94 may be omitted as long as the removing unit 90 includes a rotational body that rotates around its axis. The image forming apparatuses 10A and 10B of other exemplary embodiments may be configured similarly.

Also, in the image forming apparatus 10 of the first exemplary embodiment, the removing unit 90 configuring the second transfer unit 34 includes the first removing portion 92 and the second removing portion 94. However, the second transfer unit 34 may include, for example, a rotational body such as an auger that transports a toner T instead of the first removing portion 92 and the second removing portion 94. That is, the second transfer unit 34 may not include a rotational body that contacts the transfer unit but may include a rotational body that does not contact the transfer unit. When the rotational body that does not contact the transfer unit rotates, the rotational body vibrates the transfer unit, and the vibration causes the toner MT to fall to a transported medium P alternately at the one side or the other side in the width direction of the medium P.

Also, in the image forming apparatus 10 of the first exemplary embodiment, voltages are applied to the metal shafts 92B and 94B of the first removing portion 92 and the second removing portion 94. However, voltages may be directly applied to the conductive brushes 92A and 94A.

Also, in the image forming apparatus 10 of the first exemplary embodiment, an example of the reference ratio R2 is being larger than ½ (50%) and an example of the reference area coverage C2 is 95%. However, these conditions may be other conditions because the conditions are based on the sensory evaluation for evaluating whether or not an image with a large periodical variation in posture of the flat metal pigment MP is formed, that is, whether or not an image whose arrangement unevenness of the flat metal pigment MP is likely visually recognized is formed. For example, the reference ratio R2 may be being larger than ⅔, and the reference area coverage C2 may be 85%. The image forming apparatuses 10A and 10B of other exemplary embodiments may be configured similarly.

Also, the image forming apparatus 10 of the first exemplary embodiment executes the image forming operation in the special mode if the data of the toner image with the toner MT from the job data is included in the area A1 in FIG. 8 according to the determining step S210 and the determining step S220. However, the conditions of the determining step S210 and the determining step S220 may be changed so that the image forming operation is executed in the special mode if the data of the toner image with the toner MT from the job data is included in the area A2 in FIG. 9.

Also, in the image forming apparatus 10 of the first exemplary embodiment, the corrected area coverage C3 is, for example, an area coverage equivalent to the reference area coverage C2. However, the corrected area coverage C3 may be an area coverage different from the reference area coverage C2 as long as the corrected area coverage C3 is lower than the area coverage C1 from the data. For example, the reference area coverage C2 may be, for example, 95%, and the corrected area coverage C3 may be, for example, 90%.

Also, in the image forming apparatus 10 of the first exemplary embodiment, the corrected area coverage C3 is, for example, an area coverage equivalent to the reference area coverage C2, that is, a constant value. However, the corrected area coverage C3 may not be a constant value as long as the corrected area coverage C3 is lower than the area coverage C1 from the data.

For example, the corrected area coverage C3 may be a function of the area coverage C1. To be specific, the function of the area coverage C1 and the corrected area coverage C3 may be, for example, as follows:

$$C3(\%)=0.9\times C1(\%).$$

Alternatively, the function of the area coverage C1 and the corrected area coverage C3 may be, for example, as follows:

$$C3(\%)=C1(\%)-3(\%).$$

Figure 13:
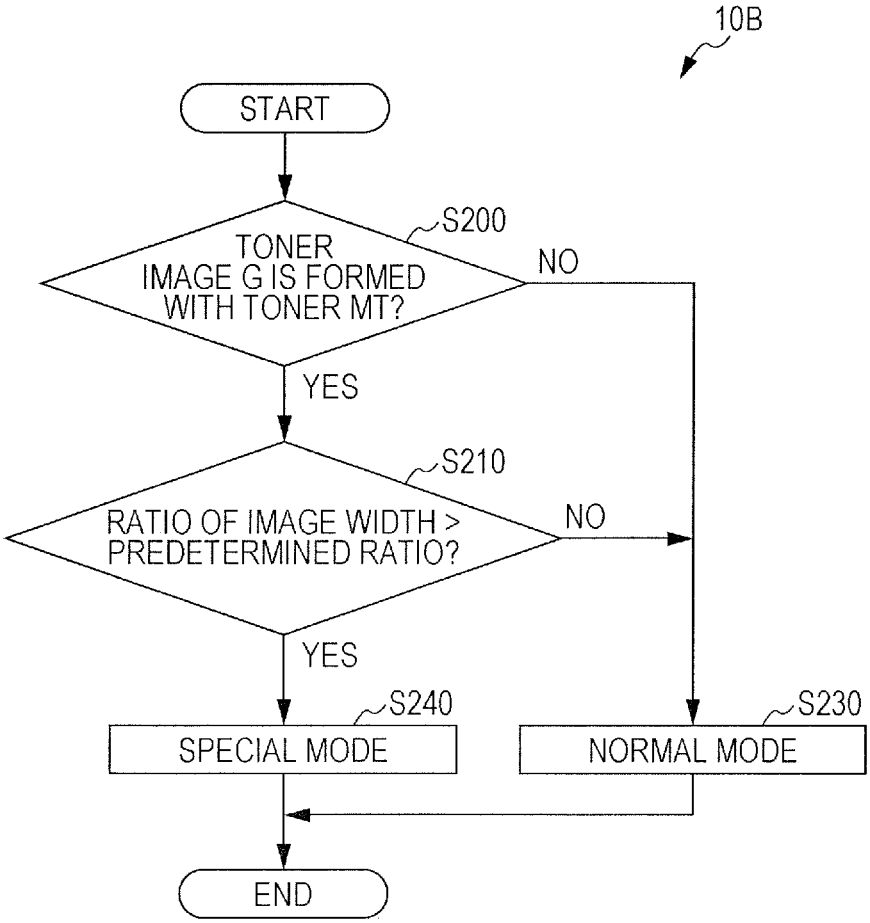
FIG. 13 is a flowchart of control that is executed during an operation of image formation by a controller configuring an image forming apparatus according to still another exemplary embodiment.

Also, in the image forming apparatus 10 of the first exemplary embodiment, the controller 60 determines the determining step S210 and the determining step S220. Also, in the image forming apparatus 10A of the second comparative exemplary embodiment, the controller 60 does not determine the determining step S210 but determines the determining step S220. However, like an example of the other exemplary embodiment of the invention (the image forming apparatus 10B), the controller 60 may control the respective units other than the controller 60 according to a flowchart in FIG. 13. To be specific, the image forming apparatus 10B of the other exemplary embodiment, the controller 60 does not determine the determining step S220, but determines the determining step S210. With the image forming apparatus 10B of the other exemplary embodiment, if the data of the toner image with the toner MT from the job data is included in the area A1 in FIG. 8, an image with a smaller periodical variation in posture of the flat metal pigment MP is formed as compared with the image forming apparatus that executes the image forming operation in the normal mode.

Figure 14:
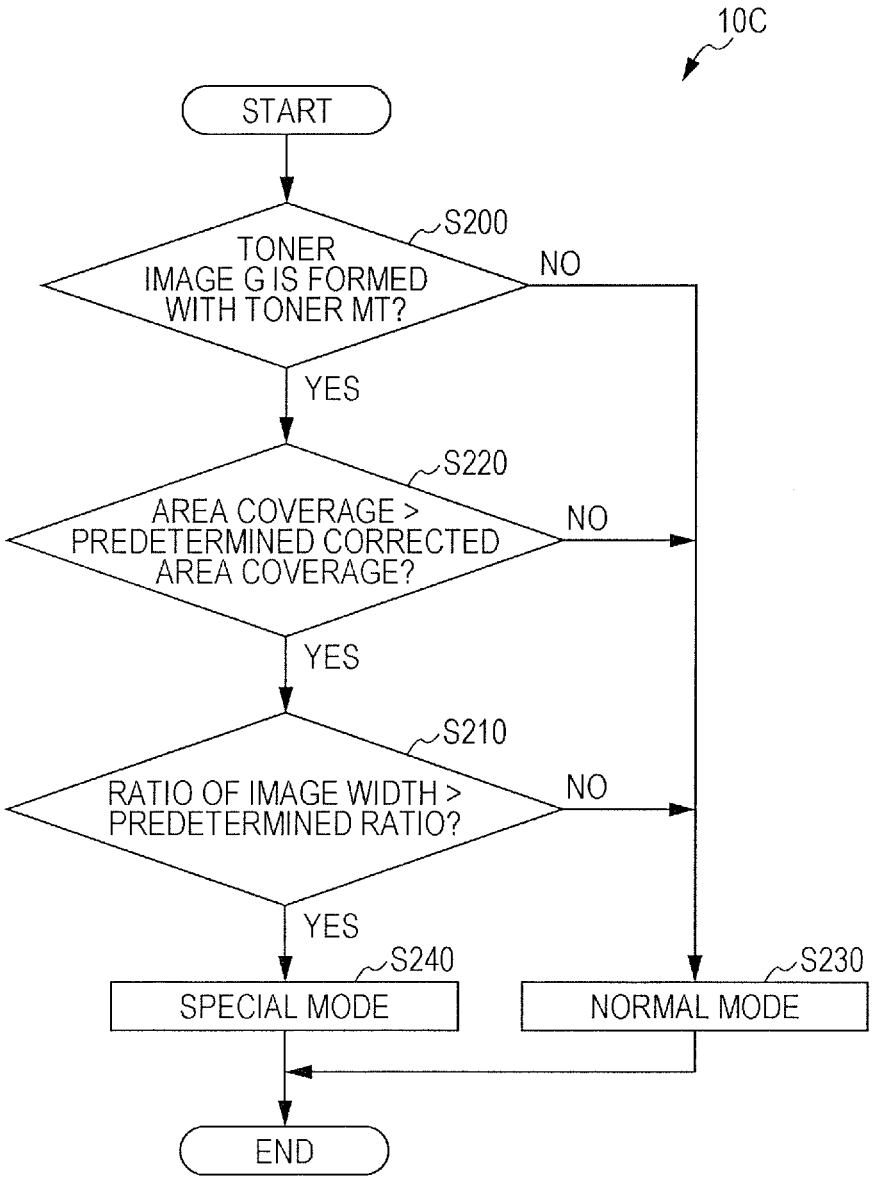
FIG. 14 is a flowchart of control that is executed during an operation of image formation by a controller configuring an image forming apparatus according to yet another exemplary embodiment.

Also, if the controller 60 of the image forming apparatus 10 of the first exemplary embodiment executes the determining step S210 if the controller 60 determines YES in the determining step S200, and the controller 60 executes the determining step S220 if the controller 60 further determines YES in the determining step S210. However, as long as the determining step S210 and the determining step S220 are executed after the determining step S200, the execution order of the determining step S210 and the determining step S220 may be inverted. To be specific, like an example of other exemplary embodiment of the invention (image forming apparatus 10C), the controller 60 may execute the determining step S210 after the determining step S220 like a flowchart in FIG. 14.

Also, in the image forming apparatus of the third comparative exemplary embodiment included in the technical scope of the invention, the ratio R1 of the image width and the reference ratio R2 are ratios with respect to the formable width on the transfer belt TB. However, the formable width is an example of a reference for the ratio R1 of the image width and the reference ratio R2, and the reference of the ratio R1 of the image width and the reference ratio R2 may be the width of other member. For example, the reference may be the maximum width of a medium P that may be transported by the image forming apparatus, the width of the transfer belt TB, the width of the conductive roller 72, the width of the BUR 80, the width of the photoconductor 22, or the width of other member.

Also, in the image forming apparatus 10 of the first exemplary embodiment, the ratio R1 and the reference ratio R2 are changed in accordance with the width of the medium P actually used for image formation. However, according to an exemplary embodiment of the invention, the width of the medium P used by the image forming apparatus is a constant width, and is applied to, for example, an image forming apparatus of an exemplary embodiment that executes image formation by transporting only a medium P of A4 size in the same direction. In this case, since the width of the medium P actually used for image formation is constant, the ratio R1 or the reference ratio R2 is not changed. The image forming apparatuses 10A and 10B of other exemplary embodiments may be configured similarly.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

a forming unit configured to form a toner image with a substantially flat toner containing a substantially flat metal pigment on a movable body;

a transfer unit configured to form a nip with the movable body and to transfer the toner image onto a medium transported to the nip; and a controller configured to receive data for allowing the forming unit to form the toner image, wherein the controller is configured to, in response to determining that the received data indicates that the forming unit is to form the toner image with the substantially flat toner containing the substantially flat metal pigment, then determine whether at least one of a first condition and a second condition is satisfied, wherein the first condition is whether the received data indicates that an image width of the toner image to be formed with the substantially flat toner containing the substantially flat metal pigment is larger than a predetermined width, wherein the second condition is whether the received data indicates that an area coverage of the toner image to be formed with the substantially flat toner containing the substantially flat metal pigment is higher than a predetermined area coverage, and wherein the controller is configured to, in response to determining that at least one of the first condition and the second condition is satisfied, cause the forming unit to form the toner image with the substantially flat toner containing the substantially flat metal pigment with a corrected area coverage lower than the area coverage indicated by the received data.

2. The image forming apparatus according to claim 1, wherein the controller is configured to, in response to determining that the received data indicates that the forming unit is to form the toner image without the substantially flat toner containing the substantially flat metal pigment, then cause the forming unit to form the toner image with the area coverage indicated by the received data.

3. The image forming apparatus according to claim 1, wherein the area coverage of the toner image to be formed represents a percentage of a number of pixels of the toner image with the substantially flat toner containing the substantially flat metal pigment developed by a developing device of the forming unit with respect to a total number of pixels included per unit area.

4. An image forming apparatus, comprising:

a forming unit configured to form a toner image with a substantially flat toner containing a substantially flat metal pigment on a movable body;

a transfer unit configured to form a nip with the movable body and to transfer the toner image onto a medium transported to the nip; and a controller configured to receive data for allowing the forming unit to form the toner image, wherein the controller is configured to, in response to determining that the received data indicates that the forming unit is to form the toner image with the substantially flat toner containing the substantially flat metal pigment, then determine whether both a first condition and a second condition are satisfied, wherein the first condition is whether the received data indicates that an image width of the toner image to be formed with the substantially flat toner containing the substantially flat metal pigment is larger than a predetermined width, wherein the second condition is whether the received data indicates that an area coverage of the toner image to be formed with the substantially flat toner containing the substantially flat metal pigment is higher than a predetermined area coverage, and wherein the controller is configured to in response to determining that both of the first condition and the second condition are satisfied, cause the forming unit to form the toner image with the substantially flat toner containing the substantially flat metal pigment with a corrected area coverage lower than the area coverage indicated by the received data.

5. The image forming apparatus according to claim 4, wherein the predetermined width is a width obtained by multiplying a width of the medium by a predetermined ratio.

6. The image forming apparatus according to claim 5, wherein the controller is configured to cause the forming unit to form the toner image with the area coverage indicated by the received data in response to a ratio of the image width indicated by the received data being equal to or smaller than the predetermined ratio and the area coverage indicated by the received data being equal to or smaller than the predetermined area coverage.

* * * * *